United States Patent [19]

Snow et al.

[11] Patent Number: 4,778,167

[45] Date of Patent: Oct. 18, 1988

[54] COLLATING SYSTEM INCLUDING CALIPER

[75] Inventors: James H. Snow, Batavia; Edward March, Jr., Mount Prospect; Richard Raffl, Glenview, all of Ill.

[73] Assignee: Alden Press, Inc., Elk Grove Village, Ill.

[21] Appl. No.: 947,705

[22] Filed: Dec. 30, 1986

[51] Int. Cl.[4] ..... B42B 1/02

[52] U.S. Cl. ..... 270/53; 270/58

[58] Field of Search ..... 270/53, 54–56, 270/58

[56] References Cited

U.S. PATENT DOCUMENTS

| | | | |
|---|---|---|---|
| 3,087,721 | 4/1963 | McClain | 270/54 |
| 3,561,752 | 2/1971 | McClain et al. | 270/54 |
| 3,622,147 | 11/1971 | Mebus | 270/54 |
| 3,685,712 | 8/1972 | Turner et al. | 227/100 X |
| 3,899,165 | 8/1975 | Abram et al. | 270/58 |
| 4,118,023 | 10/1978 | Macke | 270/54 |
| 4,121,818 | 10/1978 | Riley et al. | 270/54 |
| 4,170,346 | 10/1979 | Murray et al. | 270/54 |
| 4,484,733 | 11/1984 | Loos et al. | 270/54 |
| 4,493,482 | 1/1985 | Valenti | 270/58 |
| 4,639,873 | 1/1987 | Baggarly | 270/58 |

*Primary Examiner*—E. H. Eickholt

*Attorney, Agent, or Firm*—Russell E. Hattis; Lawrence J. Bassuk

[57] ABSTRACT

The caliper system in a booklet collating system automatically measures a new zero position before measuring the thickness of a following booklet or booklets to eliminate a zero-offset error otherwise occuring from build-up of ink contaminants on the caliper rollers. The caliper rollers are preferably cylindrical and completely round. A reference roller projects into a window in a skirt of the conveyor. A measuring roller engages the reference roller through the window and is carried on one end of a pivoted, lightweight arm that reduces the inertia required to be moved to effect the measurement. The free end of the arm is coupled by a string-pulley arrangement to a shaft encoder producing electrical position signals corresponding to the movement of the measuring roller caused by the thickness of a booklet between the caliper rollers. The position signals are received by a caliper controller that subtracts the zero position signal from each thickness signal received, usually ten for each book. The high and low differences are disregarded, the remaining eight thickness values are averaged and the controller determines whether the average thickness value represents a properly collated booklet. The controller then effect the binding of properly collated booklets and the rejection of improperly collated booklets.

26 Claims, 8 Drawing Sheets

COLLATING SYSTEM INCLUDING CALIPER

BACKGROUND OF THE INVENTION

This invention relates generally to booklet thickness calipers used on multiple feed head collating conveyor sysrems. More particularly, it relates to such calipers that provide electronic signals, compatible with electronic printing devices used with present collating conveyor systems and indicating whether a booklet engaged in said calipers is of proper thickness and has been properly collated.

Previous collating conveyor systems used a mechanical arrangement of parts extending from a pair of caliper rollers, one fixed add one movable, to set a switch if an undersigned or oversized collated booklet passed between the rollers while moving along a conveyor belt. The set switch disabled the binding stapler and effected a rejection of the booklet. More recently, the thickness of the booklet has been measured by reading analog electrical signals indicating the position of the movable roller. See, for example, U.S. Pat. No. 4,121,818 to Riley et al. A general purpose digital computer controller having an analog to digital converter uses the digitized position signals to determine the thickness of the booklet and ascertain whether it has been properly collated based upon preliminary measurements obtained through the calipers and compensation factors derived from the measurements during a make-ready or trial run mode. In the Riley et al. system, these preliminary data base determination measurements and compensation factors are used to compensate for booklet thickness variations resulting from various factors.

In the initial set up or trial run mode, the Riley et al. system takes caliper measurements of (a) three base or zero readings, with no signatures in the calipers, (b) three sample signatures from each signature feeder, (c) three standard replacement books, and (d) three books formed from all available signatures. The three values from each measurement are averaged and the average base reading is subtracted from each other average. These results, representing the average thickness for each signature, a standard book and a book containing all signatures, are stored, and an analysis of these data is performed.

The Riley et al. system then derives from the measured data reference an "air factor", which is the thickness of the air expected to be trapped between the signatures as they pass through the calipers. This is obtained by subtracting from the measured trial run thickness of the book containing all the sample signatures, the sum of the measured thicknesses of all the sample signatures, and dividing the result by the number of air interfaces. The air factor then is added to the measured thickness of each signature to result in a compensated thickness for each signature that is stored in a look-up table.

The Riley et al. system then stores a "thick tolerance" equal to the smallest compensated signature thickness and stores a thin tolerance equal to half that smallest compensated signature thickness. Lastly, the system computes and stores a "floating factor" determined by subtracting from the average measured thickness of the sample standard replacement booklets the sum of all the compensated thicknesses of all the signatures comprising the same.

In the production mode, the system adds together the compensated thicknesses of all the signatures to be incorporated in the booklet being produced during production and subtracts that sum from the actual reading obtained from the calipers for that booklet when it is completed. The floating factor then is added to the result of this subtraction operation and this second sum is compared to the "thick" and "thin" tolerances. If the difference plus the floating factor is outside the "thick" and "thin" tolerances, the book in the calipers is rejected as over- or under-sized. If the difference plus the floating factor is within the "thick" and "thin" tolerances, the book is of proper size and passes through the collating system. In this later case, the difference between the actual reading from the caliper and the calculated expected reading is added to a summer circuit that initially included the value of the floating factor. After seven additions to the summer, the new sum is averaged and is used as the new floating factor to compensate for slowly changing conditions.

There is at least one progressively varying condition however, that often occurs during a production run of booklets that may not be taken into account by the booklet production process of the Riley et al. patent, or if taken into account, is not handled in a simple or straightforward way as in the present invention. The ink from the booklets, especially if there is heavy coverage, can substantially build up on the reference roller and on the movable or measuring roller to effect a gradual change in the zero position of the calipers. This build up is gradual and evidences itself most at the end of a production run. It is non-existant at the beginning of a new run because operators clean the caliper rollers between production runs as a routine operation. The effect of the build up on the calipers is to slowly and gradually increase the apparent measured thickness of booklets engaged between the calipers so that the booklets are measured to be thicker than they actually are. This can result in properly collated booklets being rejected as oversized.

The thickness of the ink on the caliper rollers at the end of a production run typically can be one to two thousandths of an inch in a worst case condition. Previously, this had not been a problem because early mechanical systems were set to tolerances looser than the error introduced by the ink build up. The measurement made by more recent electronic caliper devices, such as is disclosed in the Riley et al. patent, however, can appreciably vary with this ink build up and, in such cases, can affect the control computer's decision as to whether or not an improperly collated booklet is being measured by the caliper. While the ink build up error can be overcome in electronic caliper devices by expanding the tolerances for properly collated booklets, such as was done in prior mechanical systems, this is unsatisfactory because it defeats the purpose of using fine electronic measuring systems. In electronic caliper systems, some means should be provided to account for this ink build up or zero offset because ultimately it can prevent an accurate precise measurement of the thicknesses of various booklets engaged between the caliper rollers.

Additionally, the caliper device used in the structure of the Riley et al. patent is cumbersome and requires that several heavy parts be moved in translation to sense the thickness of a booklet. See the Abram et al. patent, U.S. Pat. No. 3,899,165, FIG. 4 for a picture of the structure used in both the Riley et al. and Abram et al. structures. In particular, that structure includes a linear variable-differential transformer having a probe shaft that is longitudinally moved in translation through stationary transformer coils. The probe comprises the shaft moving through the coils, a roller fixed to one and of the shaft, and a measuring disc that engages with the roller, the measuring disc and its shaft being moved in turn by a booklet passing between it and a reference cam. All of these parts must be moved in translation to effect a measurement. Further, the disclosed structure is so massive that a dash pot is desirable to absorb the inertia of the moving probe.

With the advent of fine measuring systems providing precise measurements, heavy mechanical parts that must be moved in translation to effect a thickness measurement of a booklet are undesirable. They have too much inertia and a simple, lightweight device is desired that has a minimum inertia.

SUMMARY OF THE INVENTION

In accordance with one of the features of the invention, the minutely incremental build up of ink on the caliper rollers in a conveyor collating system over an extended period as thousands of booklets pass therebetween is compensated for by making a new zero position or base reference measurement immediately preceeding the measurement of the thickness of each booklet or between a desired number of booklets during the production mode of operation of the equipment involved. In the Riley et al. system, a zero or base reference measurement is taken three times and averaged only during initial set up or trial mode of operation. The updated zero position or base reference measurement is preferably made in the interval between each passage of a booklet through the caliper rollers. This new zero position or base reference measurement, whether obtained before each book is made or otherwise as by taking the measurement after a given number of thickness measurements during the production run mode of operation, then is subtracted from each thickness measurement of the booklet that is produced thereafter. This alternation of measurements occurs throughout the entire production run and eliminates in a simple, straightforward manner the zero offset error due to ink build up on the caliper roller.

In accordance with another feature of the invention, the caliper structure preferably includes a reference roller and a measurement roller, the reference roller preferably having a fixed axis of rotation, which is transverse to the booklet movement, and being arranged under one of a pair of booklet backing plates or skirts of the collating conveyor to extend into a window through that skirt. The measurement roller is mounted on one end of an arm pivoted at a fixed axis for moving the measuring roller into and out of engagement with the reference roller through the window as a booklet, or more precisely the half of each booklet straddling said collating conveyor, passes between the caliper reference and measurement rollers.

The reference roller is cylindrical and elongate along its axis of rotation, which is transverse to the booklet movement, to accommodate booklets having large dimensions from the collating chain downward. The measurement roller is also cylindrical but preferably much thinner to present a thin measurement band along a booklet and is adjustable to fix the measurement band at a desired location along the elongate dimension of the reference roller. Both rollers are preferably continuously round to minimize their cost in comparison to one having a flat portion thereon for timing or other purposes.

The caliper measurements generate electronic position signals indicative of the angular position of the arm carrying the measurement roller. When the measurement roller is engaged against the reference roller, a zero position signal is produced; when the measurement roller is spaced from the reference roller by the thickness of the booklet pages, a thickness position signal is generated related to the movement of the arm about its pivot axis. The pivot axis is arranged on the arm to provide a mechanical amplification of the movement of the end of the arm opposite that carrying the measurement roller to provide greater resolution to the generated electronic position signals.

The electronic zero and thickness position signals are received by a controller or comparator circuit that includes memory means with a storage location for the zero position signal and the booklet thickness position signal. The comparator circuit also includes a subtraction circuit that determines the difference between the signals by subtracting the zero position signal from the thickness position signal and setting a binary output signal one way or the other depending on whether the difference is substantially equal to the thickness of a properly collated booklet. The output signal then can be used to enable or disable stapling of the booket and printing of addressee alpha-numeric information and can effect a booklet removal operation so that a defective booklet is not delivered to the conveyor outlet.

In the preferred form of the invention, the controller or comparator obtains and stores a series of caliper booklet thickness readings. The controller then modulates these raw data by operating on them with a low pass filter in software to eliminate reference roller bounce and selects ten substantially equally spaced filtered readings. The zero position signal then is subtracted from each of selected thickness position signals, obtained in effect from spaced locations across the length of each booklet. The result of each of these subtractions is then stored, and after the last one is received, the high and low values are discarded and the remaining values are averaged. The average thickness value then is compared to one proper thickness value. If the average thickness value is within a certain tolerance of the one proper thickness value, the output signal indicates a properly collated booklet and stapling or other binding is enabled. Otherwise, the output signal indicates an improperly collated booklet.

In another aspect of the invention, a pivot arm encoder assembly is provided which includes a commercially available electronic shaft position encoder and a stringpulley arrangement attached to the pivot arm free end. Movement of the free end of the pivot arm in an arc about the pivot axis moves the string around a pair of pulleys, one idler and one on the shaft of the encoder and rotates the shaft of the shaft encoder. The shaft encoder then generates a signal that is processed to effect the desired digital electronic position signals received by the comparator circuit. This processing can include modifying the data received from the encoder, which represents movement of the arm in an arc, to represent movement of the arm in a straight line. This "linearizing" can be performed by known table look-up procedures.

It has been determined that the string-pulley assembly must be free of any spring that can otherwise be used to return the pivot arm to a rest or zero position.

the presence of a spring in the string-pulley system results in vibrations in the string that vary the generated position signals. These unwanted vibrations are eliminated by using only a taut string to rotate the shaft of the encoder and placing the return spring elsewhere between the pivot arm and a reference frame also carrying the pulleys and shaft encoder.

Another aspect of the invention involves reducing the inertia of the caliper mechanical parts. To this end, the arm carrying the movable measuring roller is a long lightweight structure that is pivoted for rotation around the pivot axis to effect a booklet thickness measurement, rather than being longitudinally translated to effect the measurement. Using a lightweight arm and pivoting the arm substantially reduces the inertia that must otherwise be started and stopped for the measuring roller accurately to track the booklet thickness. Additionally, the arm is arranged at an acute angle relative to the motion of the booklets between the rollers to facilitate the pivotal movement of the caliper arm.

DESCRIPTION OF THE PREFERRED EMBODIMENT

Figure 1:
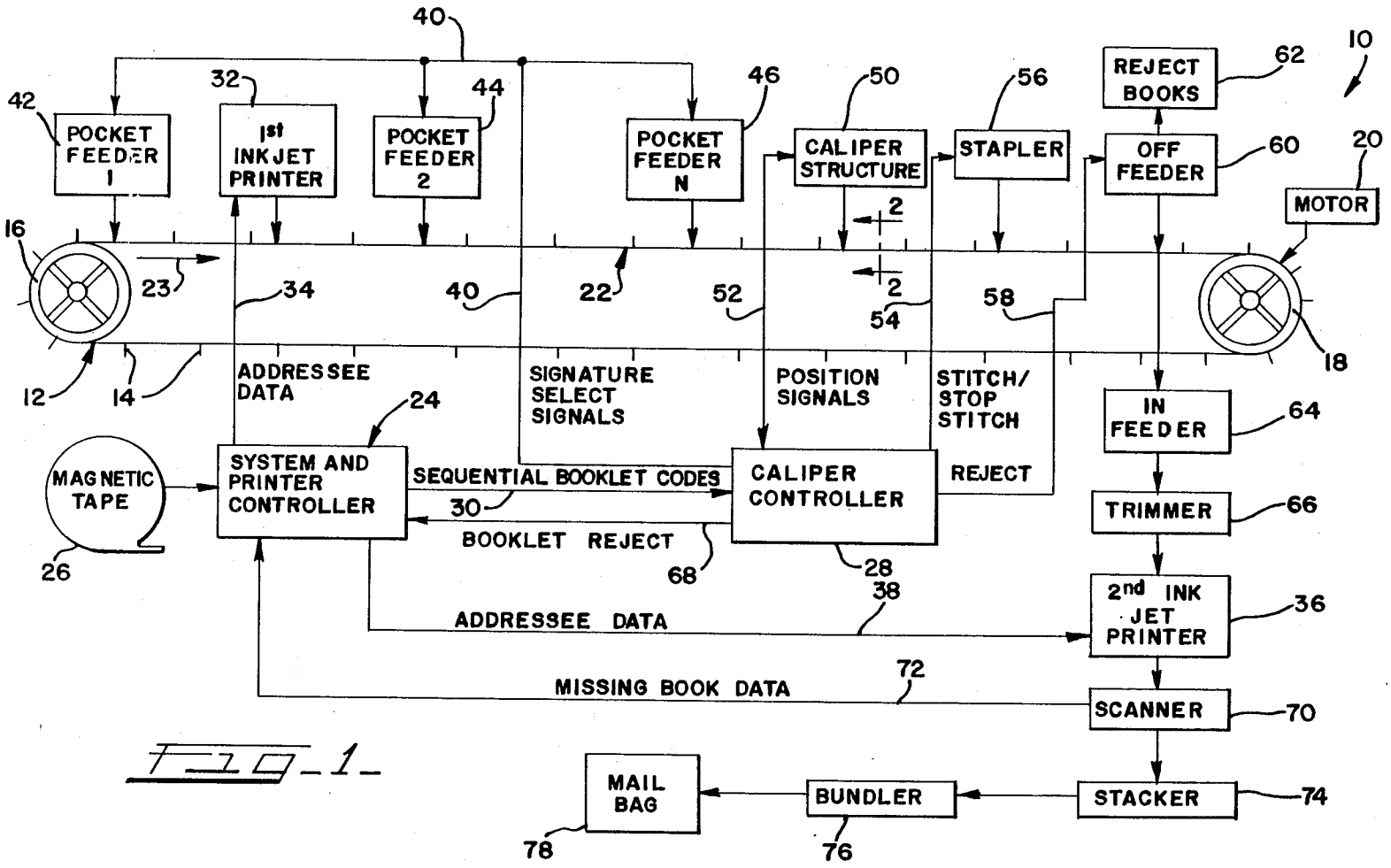
FIG. 1 is a schematic block diagram of a collating system including the caliper assembly of the invention.

In FIG. 1, a collating system 10 is provided which comprises a collating chain 12 having a plurality of pegs 14 extending therefrom and that is driven around a pair of pulleys 16 and 18 by a motor 20 in the direction indicated by arrow 23. The pegs 14 are regularly spaced along the length of collating chain 12 and each peg will be used to move one booklet (not shown in this figure) along the top reach 22 of the collating chain 12.

A system and printer controller 24 determines the construction or collation of booklets and addressee data from information stored on a magnetic tape 26. Information determining the make up or construction of the various booklets is transmitted from system and printer controller 24 to caliper controller 28 over leads 30 that carry sequential booklet codes. Controller 24 transmits addressee data to a first ink-jet printer 32 over leads 34 and later in sequence transmits addressee data to a second ink-jet printer 36 over leads 38.

A caliper controller 38 decodes the booklet codes from leads 30 and transmits individual signature select signals on leads 40 to plural pocket feeders such as pocket feeder 1, pocket feeder 2 through pocket feeder N, respectively indicated by reference numerals 42, 44 and 46. The "N" in pocket feeder N indicates that there can be as many pocket feeders as are desired. Each pocket feeder, as is known, feeds one signature of printed matter onto collating chain 12 in front of the appropriate peg 14 in response to a signature select signal being received thereby. Thus caliper controller 28 effects the collating of selected ones of the pocket feeders to place a selected signature straddling collating chain 12 to produce booklets of different signatures depending on the addressee involved.

Publishers desire different booklets formed of different signatures to be collated in sequence to maximize the advertising impact of the booklets sent to different people. To minimize mailing costs, advertising booklets for all of the anticipated customers in one postal code zone are made in a group and dispatched to the postal service in one bag. The advertising booklets in that one bag, however, probably will be of different types, the different types being customized to the past ordering patterns of the individual addressees or anticipated customers. For example, a group of customers in one postal zone may be golfers and receive a booklet containing more pages, or signatures, advertising golfing equipment than another group of customers in that postal zone who are joggers and who are more interested in advertising of running equipment. By properly arranging the different signatures in the pocket feeders and sending the proper sequential booklet codes on leads 30 from the system controller 24 to the caliper controller 28, and therefrom by the proper signature select signals to the pocket feeders 42, 44 and 46, the advertiser can send customized advertising in every postal mailing code zone to maximize his return on the cost of each advertising booklet.

First ink-jet printer 32 typically is located immediately downstream of pocket feeder 1 to print customized addressee name and information, and other desired ordering information or advertising text on the order form and envelope typically collated at the center of a stapled booklet. Sequential pocket feeders 44 through 46 then drop desired signatures onto collating chain 12 in the manner previously described.

Downstream of or after the last pocket feeder, and after the booklet is collated ready for binding, the booklet passes through a caliper structure 50. Caliper structure 50 measures the thickness of the collated booklet, or more precisely the thickness of that half of the booklet overlying one of two skirts depending from the collating chain. By measuring the thickness of half of the booklet, the entire thickness of the booklet is determined because all of the signatures from the pocket feeders straddle or hang down on both sides of the collating chain 12 and upon the two depending skirts therefrom. The caliper structure 50 transmits position signals on leads 52 to caliper controller 28, which performs comparisons to be described in determining whether the booklet is of proper thickness and therefrom has been properly collated.

If the booklet is over or under sized, caliper controller 28 generates a stitch/stop stitch signal on leads 54 extending to a binding stapler 56 downstream of caliper structure 50 that normally performs the binding of the booklets by stapling along the backbone of the booklet.

Caliper controller 28 also then produces a reject signal on lead 58 extending to an off feeder 60 that removes improperly collated signatures from the collating chain 12 to a stack of reject books 62. Therefrom the signatures of the reject books can be manually re-sorted into the proper pocket feeder bins to be reused in making additional booklets. This reduces the waste otherwise occuring with the improper collation of a desired booklet.

Booklets that are bound by stapler 56 and that are not removed from collating chain 12 by off feeder 60 are removed from collating chain 12 by an in feeder 64 that lays the booklet flat in a half-folded state. A trimmer 66 then cuts the edges of the booklets to obtain a neat and trim product, and the booklets pass to the second ink-jet printer 36.

The second ink-jet printer 36 then prints desired addressee name and address data on the outer cover of the booklet, which data conforms to the addressee data printed on the center signature. This sequencing of properly printing the outer cover and inner cover addressee data is performed by the system and printer controller 24 in response to the absence of a booklet reject signal carried on leads 68 from caliper controller 28 in timed sequence with the stitch/stop stitch and reject signals transmitted on leads 54 and 58 to the stapler 56 and off feeder 60. This exact sequencing will be explained herein. The booklets then pass from second ink-jet printer 36 to a scanner 70 to determine the presence of a booklet in the spaced sequencing of booklets through the system with missing book data being tranmitted over leads 72 to system and printer controller 24. As will be explained herein, a missing book effects the reordering of that booklet by way of new sequential booklet codes on lead 30 to caliper controller 28 to replace the missing booklet. Properly scanned booklets then pass to stacker 74, bundler 76 and into mailbag 78, which then is dispatched to the postal service for delivery to the individual addressees.

Figure 2:
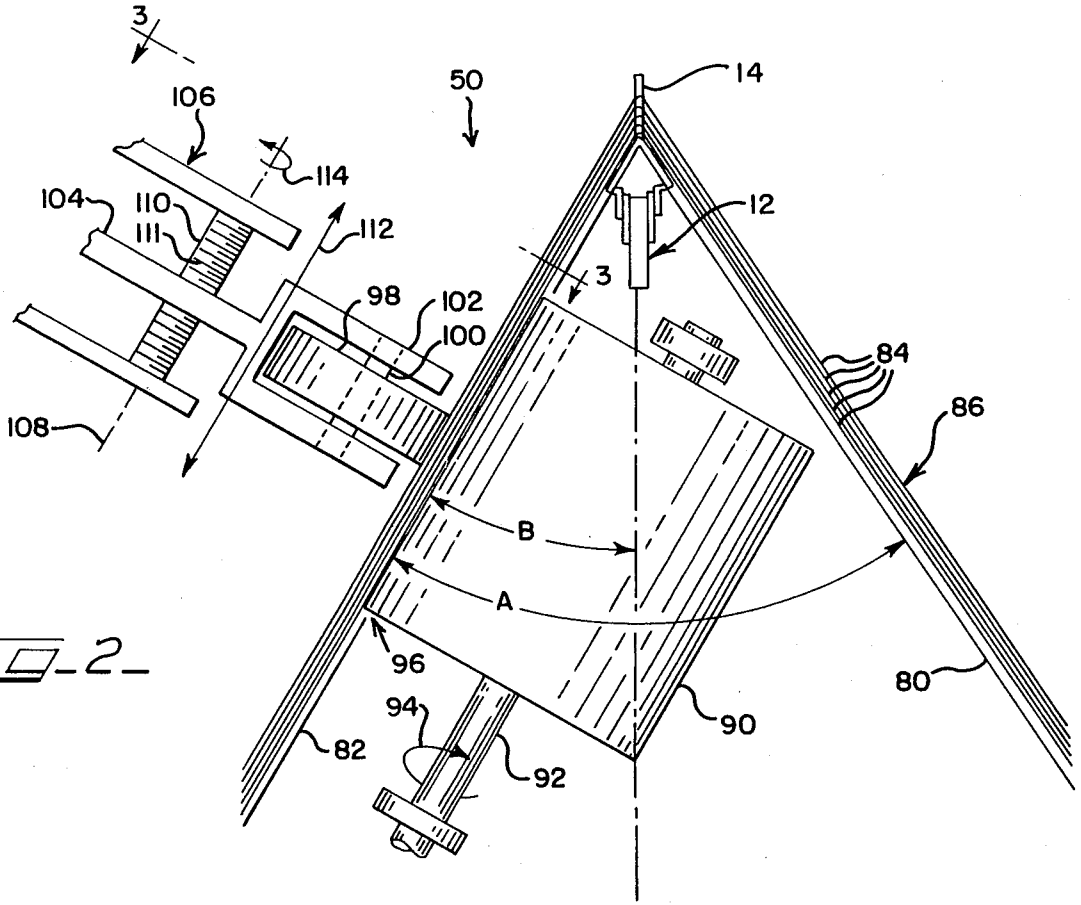
FIG. 2 is a sectional view of the collating conveyor chain including the caliper assembly invention taken along the line 2—2 of FIG. 1 and in the direction indicated by the arrows.

In FIG. 2, peg 14 extends upwardly from the structure of collating chain 12. A pair of downwardly and outwardly extending skirts 80 and 82 fixedly extend from opposite sides of collating chain 12. The plural signatures 84 of a booklet 86 are draped over and slide along the skirts 80 and 82 as the booklet is moved along by peg 14 of collating chain 12. In this manner, the booklet 86 is pushed through the caliper structure 50.

Caliper structure 50 includes a driving first reference drive roller 90 behind the skirt 82. Reference roller 90 is substantially cylindrical and is elongate to accommodate large dimension booklets extending downwardly from chain 12. It rotates in the direction indicated by arrow 94 around a fixed axis determined by shaft 92 at right angles to the direction of conveyor movement and parallel to one of the skirts 82. Reference roller 90 extends into a window 96 through skirt 82. Skirts 80 and 82 form an angle A of approximately 60° and form an angle B offset from the vertical by approximately 30°.

Caliper structure 50 further includes a measuring roller 98 that can engage against reference roller 90 through window 96. Measuring roller 98 is also substantially cylindrical but is much thinner than reference roller 90 to present a thin measuring band along the length of reference roller 90. Measuring roller 98 is mounted by a pin 100 in a forked end 102 of an arm 104 extending at an acute angle to the direction of booklet and conveyor movement. Arm 104 in turn is mounted on a stationary frame 106 to be pivoted around an axis 108 parallel to the outer face of the skirt 82. Measuring roller 98 can rotate freely around pin 100 and arm 104 can freely pivot around axis 108 to allow such as booklet 86 to be engaged between a reference roller 90 and measuring roller 98. Axis 108 is established by the pivot-forming pin 110 on the frame 106.

Arm 104, and particularly the forked end 102 can be moved upwardly and downwardly relative to frame 106 in the direction indicated by the arrow 112 by threads 111 on pin 110 so that any desired portion of the booklet 86 within the adjustment path can be engaged between the reference and measuring roller 90 and 98. In this arrangement, when a booklet 86 passe between reference roller 90 and measuring roller 98, the arm 104 pivots in the direction indicated by arrow 114.

Figure 3:
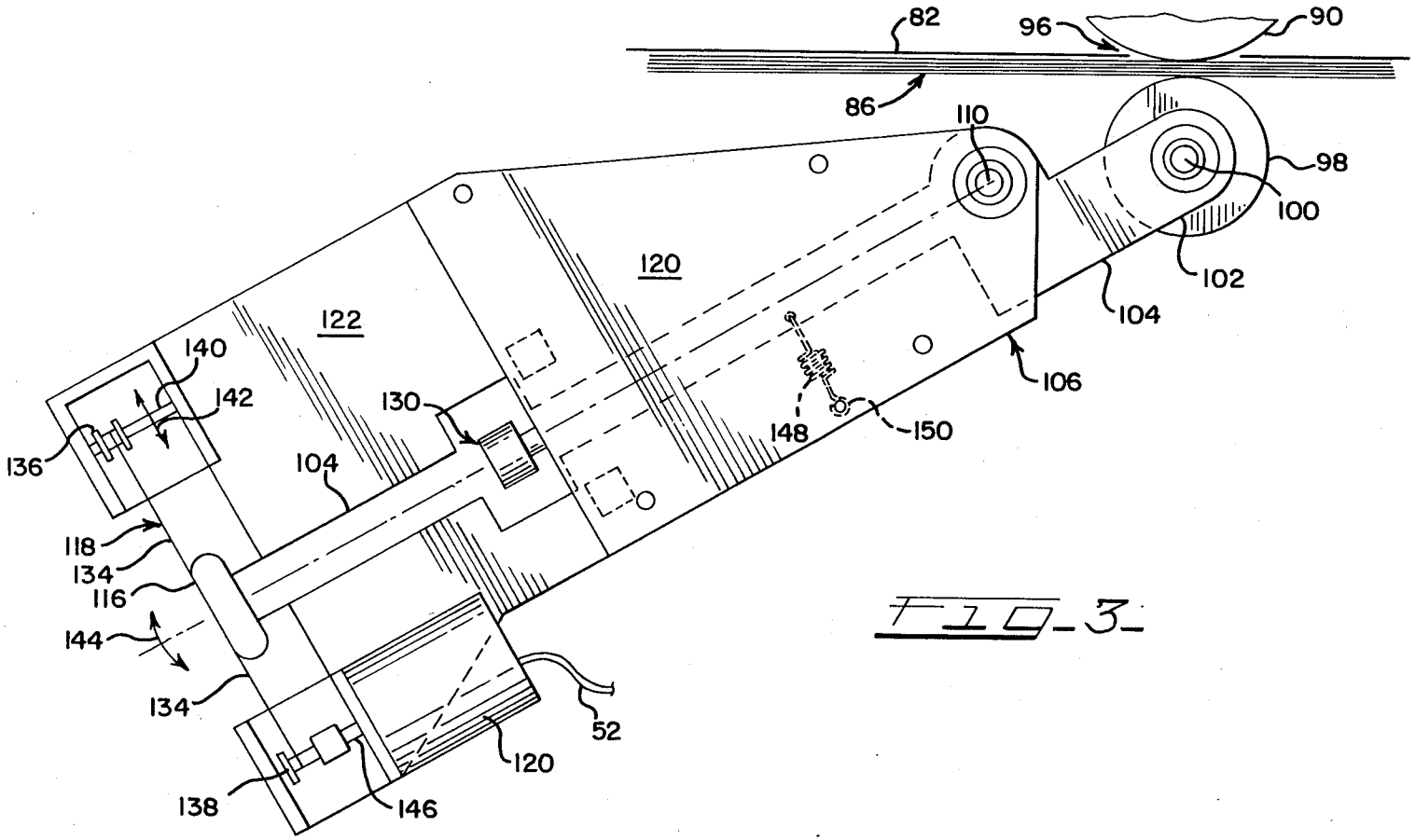
FIG. 3 is a section view of the caliper assemby of the invention taken along the line 3—3 of FIG. 2 and in the direction indicated by the arrows.
Figure 4:
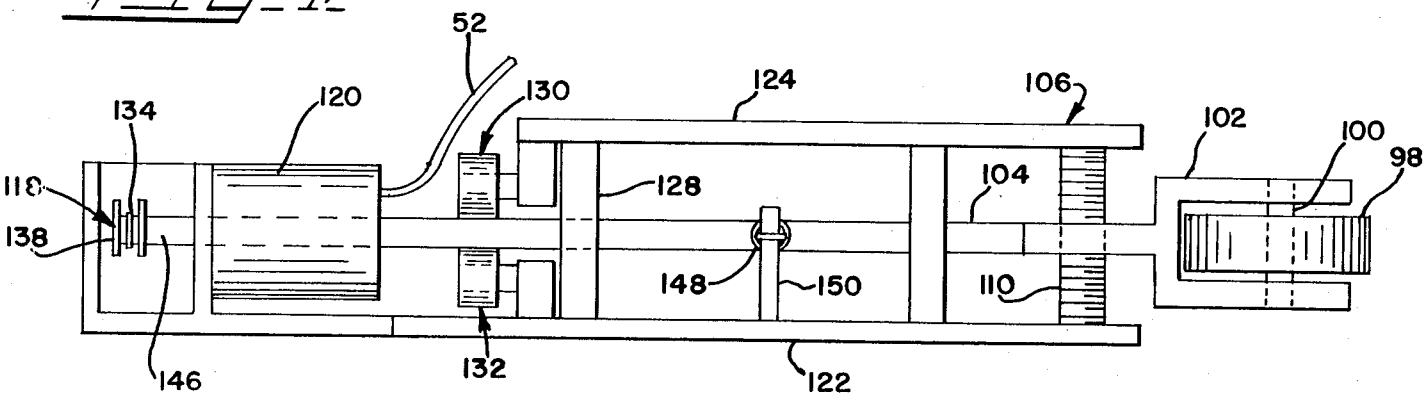
FIG. 4 is a true side elevational view of the caliper mechanism of FIG. 3.
Figure 5:
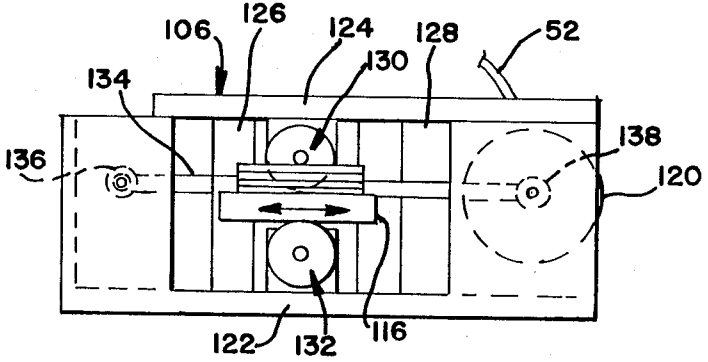
FIG. 5 is an end elevational view of the caliper assembly mechanism.

In FIGS. 3, 4 and 5, the other free end 116 of arm 104 is attached through a string-pulley arrangement 118 to a shaft encoder 120. Frame 106 includes a bottom plate 102, to which the shaft encoder 120 is mounted, and a top plate 124. Between the bottom and the top plates, there are a pair of limit posts 126 and 128 to limit the range of movement of the arm 104 and a pair of roller assemblies 130 and 132 tha respectively extend from the bottom plate 122 and top plate 124 for maintaining the free end 116 of arm 104 in a proper plane of movement.

The string-pulley arrangement includes a string 134 that is attached to the free end 116 of arm 104, passes around an idler pulley 136, passes around encoder shaft pulley 138 and returns to the free end 116 of arm 104. The tautness of the string 134 is adjusted by moving the shaft 140 of idler pulley 136 (FIG. 3) in the directions indicated by arrow 142.

The free end 116 of arm 114 thus is free to move in the directions indicated by arrow 144 in FIG. 3, and when the free end moves in those directions, such movement translationally displaces the string 134 and rotates encoder pulley 138. This in turn rotates the shaft 146 of encoder 120, which generates fine electronic position signals on leads 148 corrolated with the movement of the free end 116 of arm 104.

A spring 148 extends between a mounting post 150 and the arm 104 at a location spaced from the pivot axis 110 to bias the measuring roller 98 against the reference roller 90.

Originally, a spring was included in the string-pulley arrangement 118 to return the free end of the arm 116 to a rest position with measuring roller 98 engaged directly against reference roller 90. It was determined, however, that the presence of a spring in the string-pulley arrangement resulted in undesireable vibrations that negatively affected the electronic position signals produced on leads 52 from shaft encoder 120. Using only a string, however, with the tensioning of the string occuring by way of movement of pulley shaft 140 in the directions indicated by arrows 142 and a separate return spring 148 eliminated the need for the spring in the string-pulley system and the negative effects in the produced position signals.

Further, the construction and arrangement of the caliper structure provides for a low mass sensing of the thickness of the booklet 86. This low mass provides quick response to changes in thickness along the length of booklet 86, for such as an inserted card or opening in one of the signatures as the booklet is moved by collating chain 12, with these differences in thickness easily being sensed by shaft encoder 120 and being indicated by the position signals on leads 52. The position of pin 110 about which the arm 104 pivots relative to the overall length of arm 104 and the relative positions of the measuring roller and the string-pulley arrangement provides substantially a 4 to 1 mechanical multiplication of the movement of the measuring roller 98 away from reference roller 90. A movement of one thousandth of an inch by measuring roller 98 away from reference roller 190 then is reflected in a four thousandths of an inch movement of free arm 116 from its zero position.

The problem that occurs in this and other mechanical arrangements using rollers to determine the thickness of booklets 86 is a build up of ink on the reference and measuring rollers, or one of them, as thousands of booklets pass therebetween. Booklets that carry heavy coatings of printed ink over large areas of their surfaces can effect an ink build up on the rollers. This build up is very gradual but can result in a coating of ink on either or both of rollers 90 and 98 to a thickness of one or two thousandths of an inch. The result of the ink build up is a zero position offset in measuring the thickness of the booklets 86. Instead of the shaft encoder 120 indicating a return to the zero position, with the metal of rollers 90 and 98 engaging one another, the zero position between booklets is offset by the thickness of the ink carried on the reference and measuring rollers.

The solution to this zero offset, which occurs extremely slowly as thousands of booklets pass between the caliper rollers, the reference and measuring rollers, is overcome by effecting a re-zeroing of the caliper rollers between each booklet or between desired numbers of booklets. The elimination of the zero offset, which minutely changes from booklet to booklet, occurs by obtaining a new zero position from the caliper structure immediately following the passage of a booklet or numbers of booklets through the caliper rollers. This zero position reading then is subtracted from any measurement or measurements made of the subsequent booklet or booklets to obtain zero offset corrected thickness information.

Figure 6:
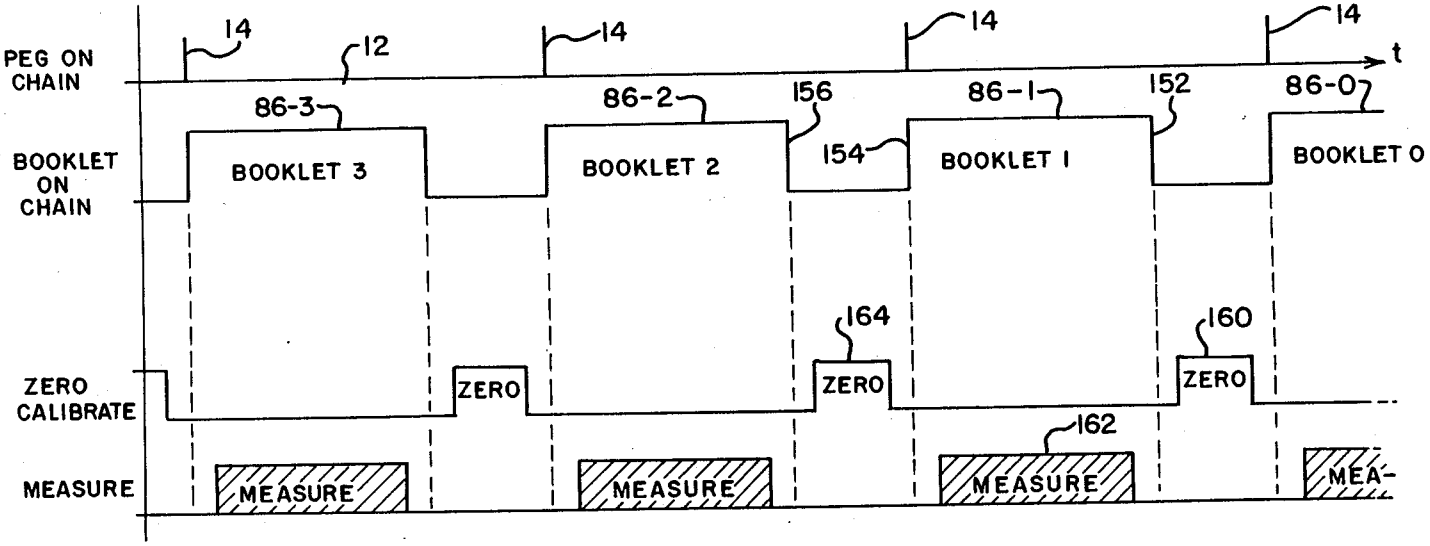
FIG. 6 is a timing diagram of the functions of the caliper assembly of the invention.

In FIG. 6, the abscissa is time and the passage of sequential booklets through the caliper rollers. The top graph line indicates the collating chain 12 carrying the regularly spaced pegs 14 extending therefrom. Booklets 0, 1, 2 and 3 pass through the caliper rollers in sequence. The timing diagram indicates that a zero calibration can occur anytime after the passage of a peg 14 and before the leading edge, such as leading edge 152, of booklet 86-1. Measurement of the thickness of such as booklet 1, indicated as 86-1, can occur anytime between the leading edge 152 of that booklet and peg 114 pushing the trailing edge 154 of that booklet passing by the caliper rollers. A new zero position reading then is taken before the leading edge 156 of booklet 86-2 passes between the caliper rollers. This alternation between obtaining new zero position readings and obtaining measurements of the thickness of the booklets continues for the entire run or sequence of collated booklets in collating system 10. Of course, the new zero position or base reference readings can occur after as many booklets as are desired.

Figure 7:
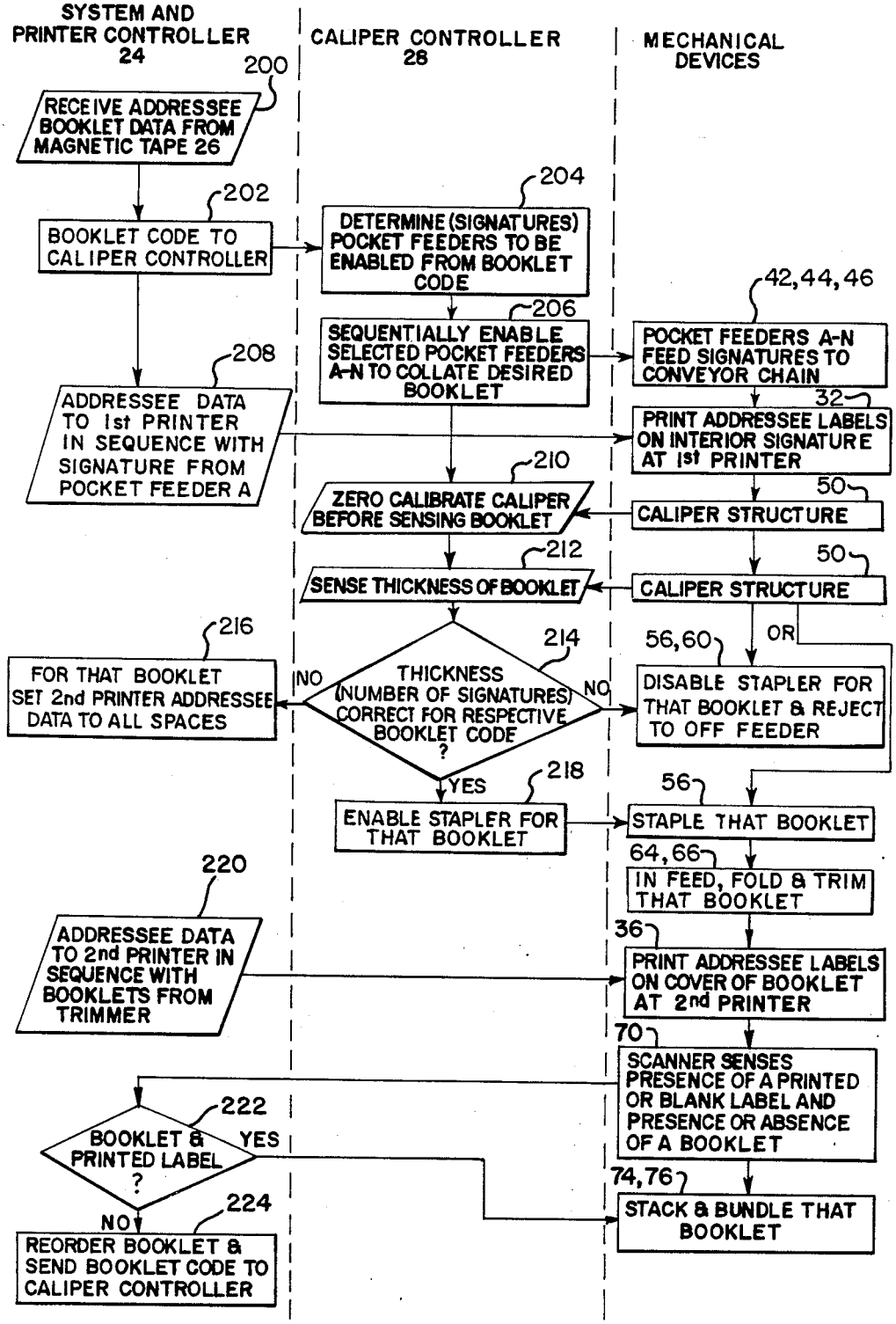
FIG. 7 is a flow chart of the operations of the collating system including the caliper assembly of the invention showig the operation of the system and printer controller, the caliper controller and the mechanical devices in respective columns.

Referring to FIG. 7, in operation, system and printer controller 24 at input block 200 receives the addressee and booklet data from the magnetic tape 26. Controller 24 processes this data and, according to process block 202, the booklet codes then are sent to caliper controller 28. In process block 204, caliper 28 determines the selected signatures or pocket feeders to be enabled in response to the received pocket code. In process block 206, caliper controller 38 sequentially enables selected pocket feeders A through N to collate the desired booklets which is reflected in pocket feeders 42, 44 and 46 feeding signatures to the conveyor chain. According to process block 208, the system controller 24 sends addressee data to the first printer 32 in sequence with the signature from pocket feeder A, and first printer 32 prints the address labels on the interior signature at the first printer.

The caliper structure 50 then sends to input block 210 a zero position signal to zero calibrate the caliper assembly before sensing a booklet thickness. This occurs immediately following the passage of a drive peg 14 past the caliper structure as has been discussed. Caliper structure 50 then sends a position signal or signals to the input block 212 of the caliper controller 28, which position signal or signals indicate the thickness of the booklet engaged therein. In decision block 214, the caliper controller 28 determines whether the thickness, or number of signatures, of that booklet is correct for the respective booklet code received from controller 24. If no, process block 216 and system and printer controller 24 operate to set the second printer addressee data to all spaces. Also, stapler 56 is disabled for that booklet and off feeder 60 is activated to reject the booklet to the stack of reject books 62. If the determination is affimative, or yes, process block 218 enables the stapler for that booklet, and that booklet passes through in feeder 64 and trimmer 66.

Output block 220 in system and printer controller 24 then transmits addressee data to the second printer in sequence with booklets from the trimmer 66. Printer 36 prints the addressee labels on the cover of sequential booklets. Scanner 70 senses the presence of a printed or blank label and the presence or absence of a booklet and transmits the information to the system and printer controller 24. Decision block 222 in controller 24 determines whether there is a booklet and printed label passing through the scanner. If no, the controller 24 proceeds to process block 224 to reorder the missing booklet and again send the missing booklet code to the caliper controller 28. If the determination in decision block 222 is affirmative, or yes, that booklet passes through stacker 74 and bundler 76 on its way to mailbag 78.

This order of events occurs for each desired booklet collated by collating system 10 with an interleaving of the steps, process blocks, input and output blocks and decision blocks for each booklet as the respective booklets pass through the collating system 10. Again, the auto-zeroing feature can be effected less frequently a may be desired.

Figure 8:
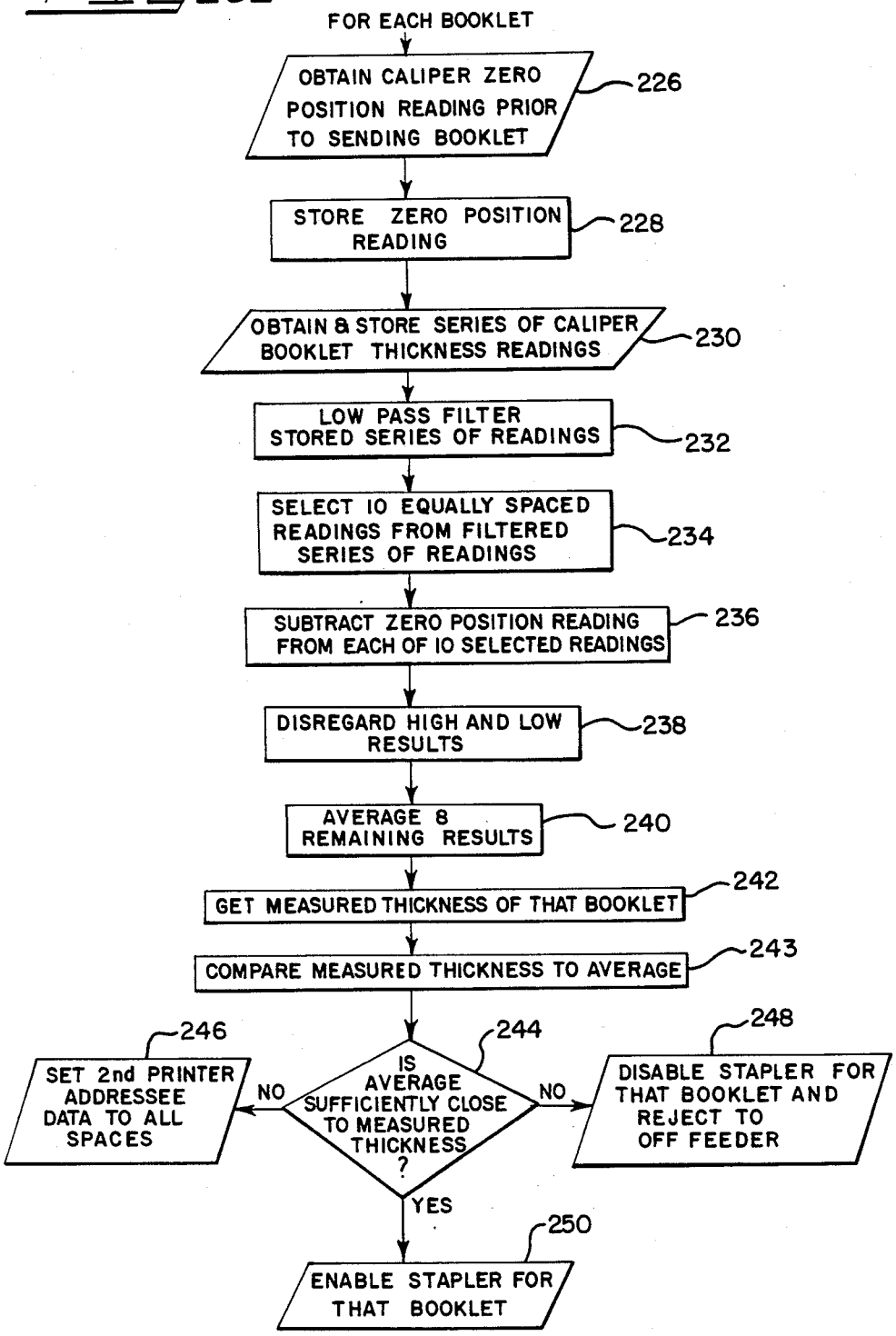
FIG. 8 is a flow chart detailing the operation of the caliper controller of the invention.

Referring to FIG. 8, the specific operation for the caliper structure and caliper controller 28 includes, at input block 226, obtaining the caliper zero postition reading prior to sensing a booklet. In process block 228, the caliper controller 228 stores the zero postion reading. In input block 230, caliper controller 28 obtains and stores a series of caliper booklet thickness readings. In process block 232, a low pass filter, effected in software and to be described presently, modulates the stored series of readings to, for example, eliminate or reduce sensor arm bounce. In block 234, the controller selects ten filtered readings from the series at substantially equally spaced locations. In effect, this simulates ten readings from across a booklet. In block 236, the controller subtracts the zero position reading from each of the ten selected readings, and in block 238, the controller disregards the high and low results of those subtractions.

In process block 240, caliper controller 28 averages the eight remaining results. In process block 242, caliper controller 28 gets the previously measured thickness for that booklet that was obtained during a preliminary procedure or as desired. In process block 243, the measured thickness and average thicknes are compared, and in block 244, a determination is made whether the average is sufficiently close to the measured thickness. In a preferred form, the comparison in block 243 is performed by a subtraction operation and in block 244, the determination is performed by checking the absolute value of the block 243 subtraction result against a desired magnitude value.

If negative, or no, the caliper controller 28 proceeds to output block 246 to set the second printer addressee data to all spaces and to output block 248 to disable the stapler for that booklet and reject that booklet on the off feeder. If the determination is affirmative, or yes, caliper controller 28 proceeds to output block 250 to enable the stapler for that booklet.

Figure 9:
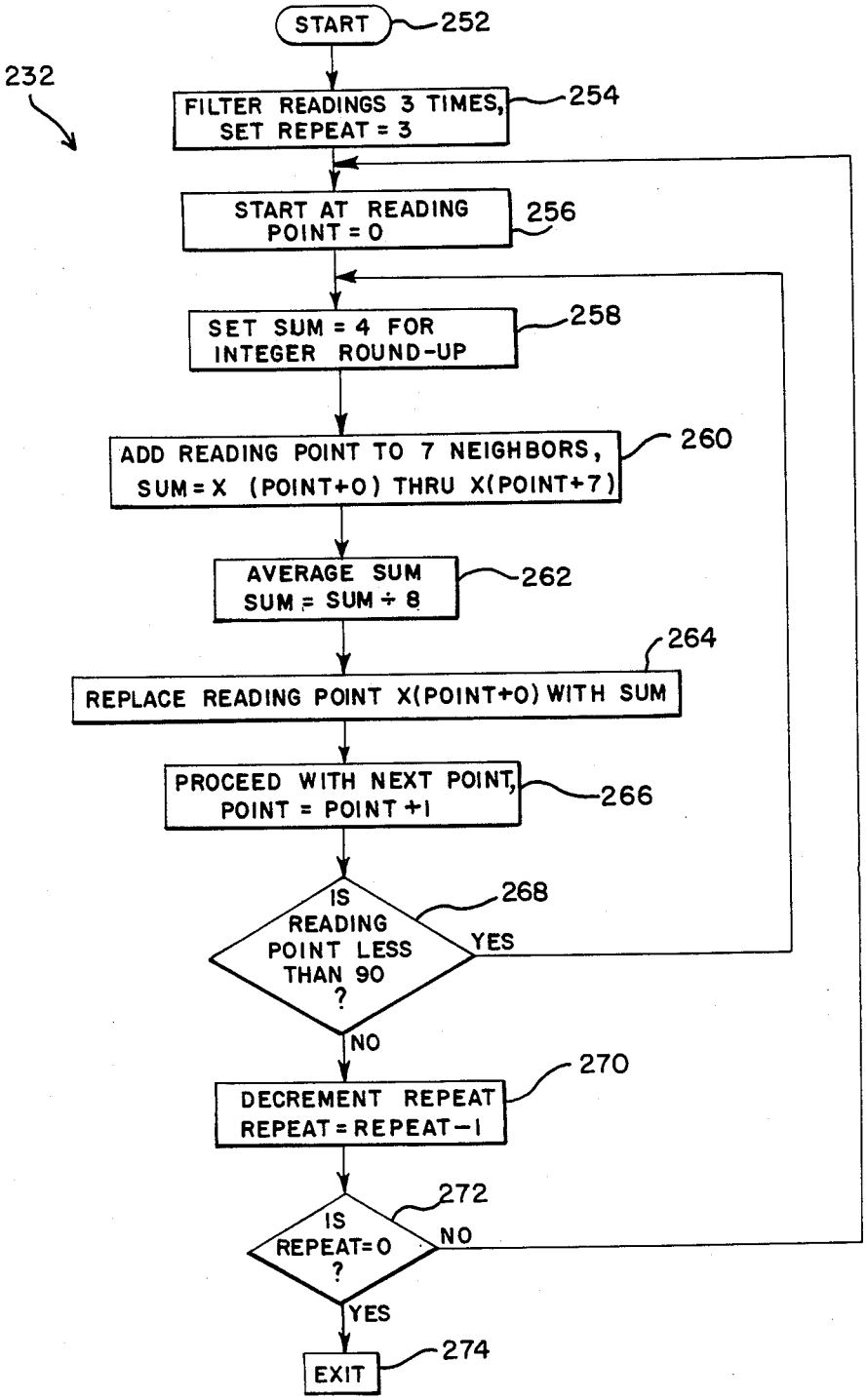
FIG. 9 is a flow chart of a software low pass filter operation.

In FIG. 9, the software implementation of the low pass filter, indicated in FIG. 8 at process block 232, starts at process block 252. The program filters the data three times, indicated in block 254, by setting register REPEAT equal to three. In process block 256, the program starts operation at caliper booklet thickness reading zero by setting register POINT equal to zero. In block 258, a sum register is set equal to four to obtain an integer roundup during the filtering process. In block 260, the value of the first reading point is added to the value of its seven closest neighbors in register SUM. In block 262, the value of register SUM is averaged, and in block 264, the value of the reading point is replaced with the averaged value from register SUM.

In block 266, the program proceeds with the next reading point and repeats the previous averaging procedure through decision block 268 if the POINT register value is less than 90, i.e. not all the readings have been filtered or operated upon. .

When all of the reading points have been averaged once, the program passes to block 270 to decrement the REPEAT register by one. If the value of the REPEAT register is not equal to one, all of the reading points again are filtered by repeating process blocks 256 through 270, determined by decision block 272. When the readings have been acted upon three times, the program ends through block 274 and returns to process block 234 in FIG. 8.

This subroutine 232 thus effects a low pass modulation or filtering of all 90 data readings by averaging each one with its seven neighbors and replacing each measured datum with an averaged datum. This smoothes the data received from the caliper to reduce discontinuities effected by such as caliper bounce at the leading edge of each booklet.

The operation of caliper controller 28, exemplified by the process blocks, input and output blocks and decision blocks of FIGS. 8 and 9, occurs in sequence as a booklet passes through the reference and measurement rollers. The measured value for each booklet code can be determined as desired, either manually by inserting calculated value for each of the different booklet codes or automatically during a set-up procedure by passing booklets of known thickness through the caliper prior to effecting a production run.

Variations of the invention are possible while remaining within the scope of the invention. For example, the specifics of the collating system and the interactions between the system controller and caliper controller can be as desired. Further, fewer or more measurements can be taken by the caliper controller, and the comparisons against the new zero-offset position signals can be made as desired. Also, the specifics of the mechanical aspects of the caliper structure can be modified as desired. For example, the reference and measuring rollers could have flat surfaces and could have line contact with each other and the booklets.

We claim:

1. An auto-zeroing caliper system that automatically compensates for build up of contaminants on reference and measuring caliper surfaces as printed booklets or the like having ink or the like transferable to said surfaces pass therebetween on a conveyor, said caliper system comprising:

A. a caliper reference surface;

B. a caliper measuring surface that is engageable with said reference surface, said measuring surface being adopted to move away from said reference surface as at least a portion of a booklet or the like on said conveyor passes therebetween;

C. measuring surface position indicator means for producing position signals indicative of the relative positions of said measuring and reference surfaces, said indicator means producing a zero position signal for a zero, contacting position of said reference and measuring surfaces, and thickness position signals when a booklet or the like is engaged between said reference and measuring surfaces;

D. memory means for containing at least data indicative of a proper thickness booklet or the like and zero position data;

E. timed means for selecting said zero position signals during production of said booklets between the intervals when said booklets are engaged between said reference and measuring surfaces and storing in said memory means zero position data indicating the relative positions of said reference measuring surfaces when they are in engagement; and F. comparator means including means for producing a first output signal indicating that a booklet or the like engaged between said reference and measuring surfaces has a proper thickness and a second output signal indicating that a booklet or the like engaged between said reference and measuring surfaces has an improper thickness, means responsive to said thickness position signals and to the stored proper thickness booklet data and said zero position data stored in said memory means for subtracting said stored zero position data from the measured booklet thickness indicated by said thickness position signal and comparing the result with the proper thickness data, and means for operating said comparator means to produce said first output signal when the booklet or the like being measured has a thickness sufficiently close to said proper thickness data to be acceptable and operating said comparator means to produce said second output signal when the booklet or the like being measured has a thickness insufficiently close to said proper thickness to be acceptable.

2. The caliper system of claim 1 in which said reference and measuring surfaces are the cylindrical and continuously round surfaces of rollers.

3. The caliper system of claim 1 including an arm pivoted between the ends thereof and carrying said measuring surface on one end thereof and said indicator means being coupled to the other end thereof.

4. The caliper system of claim 3 including a shaft encoder for generating digital signals and said indicator means include string-pulley means coupling said other end of said arm to said shaft encoder.

5. The caliper system of claim 4 in which said string-pulley means include an idler pulley, a shaft pulley and a string attached to said other end of said arm, said string passing around said idler pulley and said shaft pulley and driving said shaft encoder in response to movement of said other end of said arm.

6. The caliper system of claim 5.in which said idler pulley has a shaft that is movable to adjust the tension in said string.

7. The caliper system of claim 4 including a spring separate from said string-pulley means for biasing said measuring surface against said reference surface.

8. The caliper system of claim 1 in which said memory means has a plurality of data storage locations for storing data indicative of the thickness of a number of positions along a booklet or the like engaged between said reference and measuring surfaces, and said timed means including means for feeding to said plurality of data storage locations of said memory means data on the thickness of a number of positions of each booklet or the like indicated by the thickness position signals during a single passage of a booklet between said surfaces, and said comparator means including means for averaging said stored thickness data and comparing said average thickness data modified by said zero position responsive data with said proper thickness data.

9. The caliper system of claim 8 in which said comparator means disregard a highest and lowest stored result and average the remaining stored results and then compare the average result with said proper thickness data for setting the output signal of said comparator means to the one or the second state.

10. The caliper system of claim 8 in which said comparator means include means for low pass filtering said data on the thickness of a number of positions of each booklet or the like stored in said plurality of data storage locations of said memory means and returning said filtered data to said storage locations.

11. The caliper system of claim 10 in which said comparator means include means for selecting a certain number of filtered data from substantially equally spaced loctions in said memory means and said comparator means subtracting said stored zero position data from each of said selected filtered data.

12. A collating system for producing individually addressed booklets from plural types of signatures, said system comprising:

A. a collating conveyor having regularly spaced pins and an upper reach adapted to receive selected ones of said plural types of signatures and deliver such booklets to various successively located stations including a stapler;

B. plural pocket feeders arranged in sequence and above said conveyor and each being loaded with a respective one type of said signatures for dropping selected types of signatures onto said conveyor as selected ones of said pins pass thereunder;

C. a controller for selecting said pocket feeders to drop selected types of signatures onto said conveyor in a desired sequence to collate selected booklets;

D. an off-feeder for removing from said conveyor collated booklets passed through said stapler without binding in response to a reject signal;

E. an in-feeder for removing from said conveyor bound, collated booklets and passing them sequentially through a trimmer, stacker and bundler for dispatching the booklets to the postal service; and F. caliper means between said pocket feeders and said stapler, said caliper means comprising a caliper reference surface; a caliper measuring surface that is engageable with said reference surface, said measuring surface being adopted to move away from said reference surface as at least a portion of a booklet or the like on said conveyor passes therebetween; and measuring surface position indicator means for producing position signals indicative of the relative positions of said measuring and reference surfaces, said indicator means producing a zero position signal for a contacting position of said reference and measuring surfaces, and thickness position signals when a booklet or the like is engaged between said reference and measuring surfaces;

G. comparator means for sensing a new zero position reading of said indicator means in the interval between collated booklets passing therethrough and for subtracting said new zero position reading, derived from said zero position signal, from the booklet thickness reading derived from said thickness position signal to compensate automatically for contaminant build-up on the caliper rollers thereof and comparing the resultant data with proper thickness data; and H. control means responsive to operate said comparator means for feeding a reject signal to said off-feeder when said comparator means senses a collated booklet of an unacceptable thickness.

13. A collating system for producing individually addresssed booklets from plural types of signatures, said system comprising:

A. a collating conveyor having an upper reach adapted to receive selected ones of said plural types of signatures and deliver such booklet to various successively located stations;

B. plural pocket feeders arranged in sequence and above said conveyor and each being loaded with a respective one type of said signatures for dropping selected types of signatures onto said conveying;

C. a controller for selecting said pocket feeders to drop selected types of signatures onto said conveyor in a desired sequence to collate selected booklets;

D. a stapler for binding together said collated booklets with wire staples in response to receipt of a stitch signal and otherwise passing a collated booklet therethrough without binding same;

E. an off-feeder for removing from said conveyor collated booklets passed through said stapler without binding in response to a reject signal;

F. an in-feeder for removing from said conveyor bound, collated booklets and passing them sequentially through a trimmer, stacker and bundler for dispatching the booklets to the postal service;

G. caliper means at a caliper station between said pocket feeders and said stapler for receiving said booklets therebetween to measure the thickness thereof, said calipers having confronting measuring surfaces urged toward one another and contacting when no booklet is therebetween, said confronting measuring surfaces being spaced apart by a booklet when the booklet is delivered thereto, H. measuring surface position indicator means for producing position signals indicative of the relative positions of said measuring and reference surfaces, said indicator means producing a zero position signal for a zero, contacting position of said reference and measuring surfaces, and thickness position signals when a booklet or the like is engaged between said reference and measuring surface, I. timed means responsive to said indicator means during production of said booklets in the intervals when the booklets are not located between said caliper surfaces for storing zero position data and responsive to said indicator means during production of said booklets when each booklet is located between said caliper surfaces; and J. comparator means including means for subtracting the currently stored zero position data from the measurement of said indicator means when a booklet is between said caliper surfaces, and comparing the resultant corrected measurement to proper thickness data for the booklet involved; and K. control means responsive to said comparator means for feeding a stitch signal to said stapler to cause the stapler to operate only when a booklet has an acceptable thickness and for initiating operation of said off-feeder to remove a booklet from said conveyor only when said booklet has an unacceptable thickness.

14. In a signature collating system capable of producing booklets from plural signatures to be moved by conveyor means in a given path, system including caliper means for indicating whether each booklet is of proper thickness so that booklets of proper thickness can be bound and finished and booklets of improper thickness can be rejected said collating system comprising:

A. controller means for selecting certain ones of said signatures for each desired booklet and placing them on a conveyor in overlapping relation to form booklets after they are bound and;

B. a pair of caliper surfaces to be in the path of movement of said signatures between which each booklet is passed, at least one of said surfaces being of a size and configuration to engage the booklet at points encompassing a length much less than the length of the booklet measured in the direction of the movement of the book between the calipers so that a number of different thickness measurements can be obtained during a single pass of a booklet between said surfaces;

C. indicator means for producing position signals indicative of the relative positions of said caliper surfaces when a booklet is engaged therebetween;

D. memory means for storing a proper thickness datum for each desired booklet and capable of storing plural booklet thickness position data responsive to signals from said indicator means for each booklet;

E. means responsive to the passage of each booklet between said caliper surfaces for storing in said memory means a plurality of booklet thickness position measurements during a single pass of a booklet therebetween; and F. comparator means including means for averaging the stored plural booklet thickness position signals for each booklet, said comparator means comparing the average to the proper thickness datum for that booklet and producing an output signal indicating whether or not the booklet is of proper thickness.

15. The collating system of claims 1, 13 or 14 wherein said caliper surfaces are the peripheral surfaces of cylindrical rollers rotatable about its longitudinaly axis which extends transversely to the direction of movement of the booklets by.

16. The collating system of claim 15 wherein one of said rollers has an axial length less than the corresponding dimension of the booklet to be engaged thereby, and means for progressively adjusting the position of said one roller relative to said corresponding dimension of said booklet.

17. The caliper system of claim 14 in which said means for averaging includes means for disregarding the highest and lowest booklet thickness position signals in averaging the stored booklet thickness position signals.

18. A caliper device for use on a collating machine that produces booklets of different thicknesses by collating selected ones of plural types of signatures at individual stations along a conveyor, said device comprising:

A. an elongate reference roller having an axis of rotation fixed in position adjacent said conveyor so that at least portions of said booklets pass thereover; and B. a frame fixed in position adjacent said conveyor and reference roller, said frame including:

i. an arm having two ends and being pivoted between said two ends on said frame, one of said ends carrying a measuring roller having an axis of rotation parallel to the axis of the reference roller and said one end being swingable about said pivot to bring said measuring roller into tangential engagement with said reference roller and engage at least a portion of a booklet therebetween; and ii. an electronic encoder fixed on said frame and having a rotatable shaft coupled to the other end of said arm by a string-pulley arrangement so that movement of the other end of said arm effected by a portion of a booklet moving said measuring roller from said reference roller effects a rotation of said shaft to generate an electronic position signal corresponding thereto.

19. A caliper device for use on a collating machine that produces booklets of different thicknesses by collating selected ones of plural types of signatures at individual stations along a conveyor, said device comprising:

A. a reference surface; and

B. a frame fixed in position adjacent said conveyor and reference surface, said frame including:

i. an arm having two ends and being pivoted between said two ends on said frame, one of said ends carrying a measuring surface and said one end being swingable about its pivot axis to bring said measuring surface into engagement with said reference surface and engage at least a portion of a booklet therebetween; and ii. an electronic encoder fixed on said frame and having a rotatable shaft coupled to the other end of said arm by a string-pulley arrangement so that movement of the other end of said arm effected by a portion of a booklet moving said measuring surface from said reference surface effects a rotation of said shaft to generate an electronic position signal corresponding thereto.

20. The caliper device of claim 19 in which said reference surface is a roller that is cylindrical and substantially round about its circumference.

21. The caliper device of claim 19 in which said pivot arm is acutely angled relative to the direction of motion of said booklets across said reference surface to minimize the inertia of the arm that must be pivoted when a booklet moves said measuring surface away from said reference surface.

22. The caliper device of claim 19 in which said pivot is arranged to provide an amplification of the swing of the other end of the arm in response to the movement of the measuring roller.

23. The caliper device of claim 19 in which said frame includes retainer means for maintaining said other end in a fixed plane when swung by movement of said one end.

24. The caliper device of claim 23 in which said retainer means include a pair of rollers above and below said arm.

25. The caliper device of claim 19 in which said shaft of said encoder carries a pulley, said frame carries a pulley opposite said shaft pulley and there is a string coupling movement of said other end of the arm to said pulleys and the shaft of the encoder.

26. The caliper device of claim 25 in which the pulleys are substantially in the plane of movement of the other end of the arm.

* * * * *